United States Patent [19]

Clark

[11] 4,120,061

[45] Oct. 17, 1978

[54] PNEUMATIC MATTRESS WITH VALVED CYLINDERS OF VARIABLE DIAMETER

[76] Inventor: Harold E. Clark, 14 Beacon Hill, Fairport, N.Y. 14450

[21] Appl. No.: 841,658

[22] Filed: Oct. 13, 1977

[51] Int. Cl.[2] ..... A47C 27/08

[52] U.S. Cl. ..... 5/350; 5/349; 5/365; 297/DIG. 8

[58] Field of Search ..... 5/349, 350, 365; 297/DIG. 8; 128/33

[56] References Cited

U.S. PATENT DOCUMENTS

| | | | |
|---|---|---|---|
| 3,768,501 | 10/1973 | Elson et al. | 5/365 |
| 3,879,776 | 4/1975 | Solen | 5/350 |
| 4,005,236 | 1/1977 | Graebe | 5/350 |

*Primary Examiner*—Casmir A. Nunberg

*Attorney, Agent, or Firm*—Shlesinger, Fitzsimmons & Shlesinger

[57] ABSTRACT

Each mattress comprises a plurality of valved cells or cylinders held by a cover in side by side relation. Each cell is made from flexible, essentially inelastic material, and comprises upper and lower cylindrical sections of equal diameter interconnected by one or more corrugated cylindrical sections of smaller diameter. Each lower cylindrical section has an orifice which connects the interior of the cell with an air plenum that extends along the entire underside of the mattress, and which registers with a valve that projects from the inner surface of the plenum opposite the cell orifice. Each orifice may be supported by a small, collapsible section of the cell in a normally open position, so that when a load is applied to the top of the cell it automatically closes the orifice against the registering valve; or, alternatively, the valve may be insertable manually into the orifice to seal it until once again manually removed.

17 Claims, 10 Drawing Figures

PNEUMATIC MATTRESS WITH VALVED CYLINDERS OF VARIABLE DIAMETER

This invention relates to air mattresses, and more particularly to novel mattresses produced from a plurality of resilient air cylinders of variable diameter.

Most conventional air mattresses comprise simply a flexible enclosure filled with air. When depressed, the enclosure depresses slightly in the vicinity of the loading and also increases pressure in the remaining volume of the enclosure. The general response is resistive, elastic and bouncy, all of which responses are undesirable characteristics as far as the comfort of the user is concerned. Reference is made, for example, to U.S. Pat. Nos. 2,415,150; 2,039,289; 2,301,096; 2,627,077; 2,897,520; and 3,261,037, which disclose various forms of pneumatic cushioning devices.

It is an object of this invention therefore to provide an improved air mattress, which utilizes a mode of pneumatic response which overcomes the usual feeling of air mattresses, replacing the elastic or bouncy feeling with localized softness and conformity, backed by stiffness.

A further object of this invention is to provide an improved air mattress of the type described which offers localized response to the local weight per unit area of the body resting upon it.

A further object of this invention is to provide an improved air mattress of the type described which is made from a plurality of separate air cylinders or cells, all of which can be filled at once from a single opening in the mattress, yet each of which cylinders is capable of isolating a volume of air for each body area that it supports.

Another object of this invention is to provide an improved air mattress of the type described, which provides an extremely soft initial response to a load by allowing small amounts of air to escape locally from separate cylinders within the mattress upon initial application of the load.

Other objects of the invention will be apparent hereinafter from the specification and from the recital of the appended claims, particularly when read in conjunction with the accompanyinlg drawings.

Figure 1:
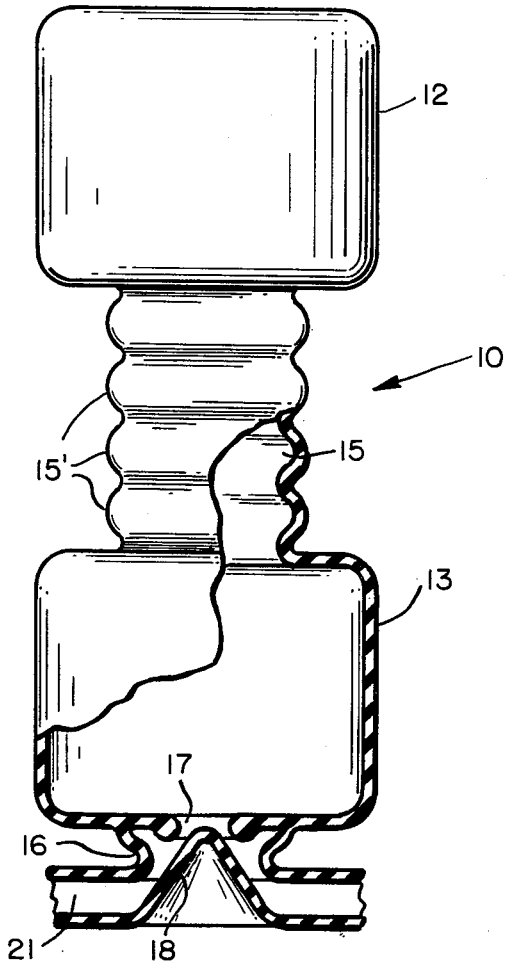
FIG. 1 is a fragmentary vertical sectional view taken through the center of a first compressible air cell which forms part of an air mattress made according to one embodiment of this invention, part of the cell being shown in full.

Before referring to the drawings it is important to realize that a cylinder of air at atmospheric pressure, and of uniform diameter is quite stiff with respect to average body weight. Utilizing as a reference for human body data the book *Humanscale,* (by Niels Diffrien et al., Henry Dreyfus Associates, publisher), the trunk area of the male (172 pounds or 78 kg.) of mean size can be taken as 35.7 kg. and occupies in a flat position an area of 2,190 $cm^2$. This corresponds to an average pressure of 0.016 $kg/cm^2$ exerted by the trunk.

Let us consider a straight-sided cylinder 6 inches long and filled to zero gauge pressure, or 1 atmosphere, which is 1.034 $kg/cm^2$. Let us also assume that it has a diameter of 3 inches, although we shall not need this piece of data presently. Loading such a cylinder with the pressure of 0.016 $kg/cm^2$ of the average body will increase the internal pressure by 1.6% and decrease its volume by about this amount. A decrease in height of 1.6% in a 6-inch cylinder amounts to only 0.096 inch, a very unyielding response. If an assembly of such straight-sided cylinders were used as a mattress, it would feel very unconforming and uncomfortable.

Figure 2:
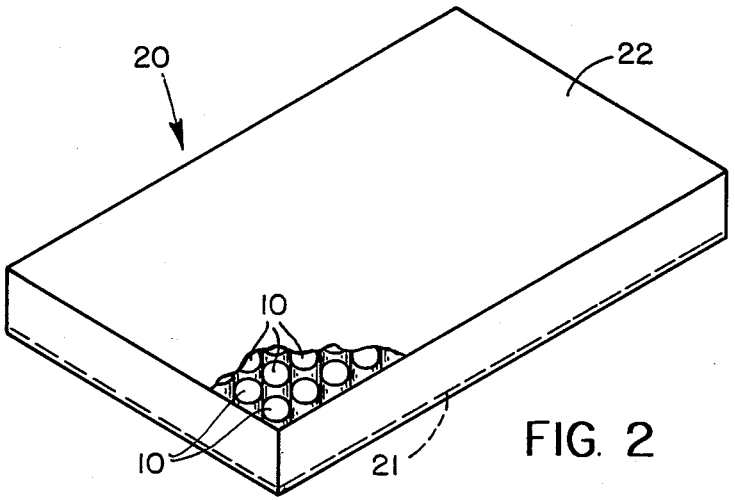
FIG. 2 is a perspective view of this mattress on a smaller scale, and with a portion of its cover cut away.

For the purposes of illustration of the principles involved in the invention, reference is made to FIGS. 1 and 2, wherein 10 denotes generally a stepped, flexible cell or cylinder, which may be, merely by way of example, 8 inches long. The mattress 20 (FIG. 2) made from an assembly of such cells is held together at the bottom by a common air plenum 21 and is covered with a soft pad 22. It may be surrounded by a cloth cover.

Each cell 10 comprises two spaced sections 12 and 13, each of which may be 2.5 inches long and 3.0 inches in diameter. These two sections constitute the sections of largest diameter. Separating and interconnecting the sections 12 and 13 is a pleated section 15 which may be 1.5 inches in diameter and 2.5 inches long. Another section 16, which is smaller both in diameter and length than either of the previously described sections, is at the bottom of the cylinder 10, and attaches section 13 to plenum 21. Also shown in FIG. 1 is an orifice 17 in the bottom of section 13, and a valve 18, which is integral with the wall defining one side of plenum 21.

In mattress 20 all the parts shown are cylindrical in cross section with the exception of plenum 21, which extends under the entire array of cells 10, and by which all the cells are filled with a gas. The large sections 12 and 13 of each cell 10 in the mattress are in near contact with adjacent large sections, which nest with it in a square or, optionally, hexagonal array.

Section 15 is the principal compressible element of each cell 10. For the dimensions chosen in the text and shown in this drawing, it will compress for amounts ranging up to about its full length in normal use. Pleats 15' are shown in cylindrical portions in order to establish a consistent pattern of compression.

The cell 10 (FIG. 1) is shown in its open condition, which characterizes it while filled but not under load. When loaded, cylindrical section 16 first compresses, and orifice 17 descends upon valve 18 and seals the cylinder. All portions of the mattress assembly comprise an impervious and inextensible film or cloth-like material, except that orifice 17 and valve 18 must be of stiff enough material to preserve the seal under pressure. Under load on a cell 10, plenum 21 will also collapse in that vicinity.

Let it be assumed that a body load is applied to the top of the cylinder 10. Although the valve 18 is open as shown in FIG. 1, wherein it is spaced from the orifice 17, let it be assumed that air can escape only so slowly that there is a build-up of pressure within the cylinder 10 while the air is escaping therefrom into plenum 21. The laws governing gas pressure within a structure like that in FIG. 1 dictate that the net forces will exert the maximum compressive force on the cylindrical section of smallest diameter. By design choice, this is the bottom section 16, which supports the orifice 17 for the valve 18. Its dimensions are chosen so that it will collapse under a very small pressure, and by a sufficient amount to close the valve 18. This act of closure is the primary purpose of the portion of the cylinder 10 comprising the orifice 17, the valve 18 and the cylinder section 16 of smallest diameter. It also has a secondary purpose, which shall be described subsequently.

With the valve 18 now closed, wherein it projects into orifice 17 in sealing engagement with the peripheral surface thereof (not illustrated), attention is turned to the behavior of the cylinder 10 in the sealed state. The smallest section 16 at the bottom will continue collapse under collapseunder the load until it can collapse no further. This amounts to a total compression of about one-half inch in the illustrated example. This takes place so as to provide a very soft response.

Before proceeding with a calculation it shall be assumed that the stepped cylinder 10 is made of inelastic material, so that the increased pressure cannot cause it to stretch. Nevertheless, the various sections can and will bulge into more spherical shapes, but such a change is sufficiently small so that it can be ignored. In any event, it is in a favorable direction, since the change toward sphericity causes a reduction in height and is a spring-like response. A second consequence of the bulging will be the exertion of lateral pressure on the thick sections of adjacent cylinders in the mattress from the bulging of the thick section of the loaded cylinder 10. This could make such effected neighboring cylinders slightly more pressurized and hence stiffer, but again this is only a second-order response which does not affect the general behavior significantly. These effects shall be ignored in the remaining discussion, since they are neither significant nor adverse.

If the load is sufficient, the pressure in the now-sealed cylinder 10 will continue to rise, and the other section 15 of small cross section will experience compressive force and begin to collapse. The laws governing gas physics teach that it will compress and thus decrease the internal volume and increase the internal pressure until that pressure equals the applied weight divided by its cross-sectional area. A second effect, not pursued in the subsequent discussion, will be that the top surface of the large cylinder will be pressurized upward as load is applied, because the internal pressure will rise.

For purposes of illustration the stepped cylinder will be loaded with the same body weight as before. It should be noted, however, that although the small intermediately located cylindrical section 15 has a diameter of only 1.5 inches, it supports a body section for an area represented by the larger cylinder, or four times that. (The body weight assignable to one cylinder 10 actually is a square 3.0 inches on a side, if the cylinders are assembled in a rectangular array; but for simplicity we shall make the comparison with the previous case where a cylinder was used. The approximation does not affect the principles of the argument, nor the numerical results in a gross way.)

Because of this concentration of body weight on a small area, the effective pressure on the small cylinder is not 0.016 kg/cm$^2$ as before, but four times this, or 0.064 kg/cm$^2$. The internal pressure will hence rise from 1.034 to 1.098 kg/cm$^2$ and the volume will decrease accordingly. This decrease in volume will appear as a decrease in height of the 1.5 inch diameter portion 15, and of the entire cylinder 10, by 1.35 inches, plus of course the decrease of one-half inch of the smallest cylinder 16 at the bottom. This calculation ignores bulging, which will decrease the depth slightly.

To a good approximation, the compression of the intermediate-sized cylinder 15 is proportional to the load. In the case of a body lying supinely, sections of greater weight per unit area, such as the hips and shoulders, will sink by a little more than this, and the small of the back, with a smaller weight per unit area, will sink less. The support height of these respective sections will differ by perhaps one-half inch. Hence the body will be contoured and supported at close to its relaxed shape, with each part resting on the soft pad supported underneath by a taut cylinder top.

Consider now the body resting in the lateral position. Here the same trunk weight of 37.6 kg has a cross section of 1290 cm$^2$, as given by an interpretation of the diagrams in *Humanscale,* and the average pressure is now 0.029 kg/cm$^2$. Pursuing the same calculation as before, this will cause the 1.5 inch cylindrical section 15 to compress by 2.3 inches. As before, the heavier sections in the shoulders and hips will compress the mattress 20 slightly more than this in those respective areas and the waist will compress it slightly less, if the body is thinner and lighter at the waist. Each section of the body will again conform well to its normal shape, and will be supported on a soft pad resting on pressurized columns of air. There will be no hammock-style sagging or curving of the spine, since each section is supported vertically by its own cylinder of air.

The results given in this calculation, namely the degree of local response obtained for a given body weight, are of course dependent on the dimensions chosen for the cylindrical sections, and can be altered widely to achieve various degrees of conformity. Among these dimensional parameters, the diameter and total length of the large sections 12 and 13 are fixed within fairly narrow limits. On the one hand, there is no need to respond to localized loads smaller than about 3.0 inches on a side. On the other hand, at a diameter exceeding 4.0 inches or perhaps 5.0 inches, the cylinder becomes too large to correspond to a body area for which an individual response is desired. We shall confine discussion of this parameter to the 3.0 inch diameter, although 4.0 or 5.0 inches may constitute tolerable values. The combined length of these large sections cannot be chosen as much below 5.0 inches, or else the volume it contains will be too rapidly affected by the load, and its response will be rather stiff. For reasons given below, it should also not be much longer than perhaps 6 inches, in order to avoid unpleasant sinking when subjected to extreme local loads.

The principal dimensions in which design sensitivity shows up concerns the small intermediately located cylinder 15. The less its area, the greater will be the pressure upon it and the larger the change in pressure and volume which will occur for a given load. Hence it will compress and decrease in length to a greater degree. This means that if the cylinders are relatively small the resulting overall mattress comprising a packed collection of cylinders will conform more to local variations in body pressure. If they are relatively large, the mattress will be stiffer and less conformable. A probable range of diameters is 1.0 to 2.0 inches, except that, as we shall see, the boundaries or edges of the mattress may be treated differently, to accommodate sitting.

The length of the small intermediately located cylinder 15 has an effect primarily on the volume of gas. Also, it must be sufficiently long to exceed the depth to which it will be compressed in normal body loading. Hence the upper limit may be about 4.0 inches, and 3.0 inches may be adequate.

Also, this section 15 need not be of a single diameter. It can consist of a sequence of sections of increasing diameters, either in steps or in a continuous change. In such designs, the section will compress successively from the narrowest to the widest sections. Unlike a cylinder of uniform diameter, it will become increasingly stiff with increasing load. This will lead to a different profile for a body at rest upon such cylinders. The various options so available from such choices in dimensions may be offered to various users who have individual preferences as to how a mattress should feel. Finally, the location of this cylindrical section 15 within the overall cylinder is not critical. In the extreme it can constitute the top section of the cylinder, or it can be placed at any depth down to just above the orifice cylinder.

A feature of the overall design is that the large sections 12 and 13 of the cylinders are designed to be in contact with similar sections of neighboring cylinders, and move up and down against them. This packing gives lateral stability to the mattress as a whole.

In addition to conforming as desired to loads of the normal supine and lateral body, a mattress must not collapse unpleasantly under the extreme pressure of a knee, or of a hand supporting a large portion of the body load, or of the load of a seated figure. It can easily be shown that, if the cylinder under load collapses down to sections within it of full diameter, at this stage the stiffness is adequate for maintaining a reasonable height for these cases.

Consider one hand taking the entire trunk load of 35.7 kg on one cylinder 10. This will first collapse the intermediate-sized cylinder 15 entirely. Since the smaller cylinder section 15 has a volume one-eighth of that of the combined larger sections 12 and 13, this will first raise the pressure to 9/8 or 1.125 times atmospheric pressure. The cross-sectional area of a 3-inch cylinder is 45.6 $cm^2$, so that this trunk load amounts to about 0.8 $kg/cm^2$ of about 0.8 atmosphere. Hence the compressed relative height of the larger cylinders must be 1.125/(1.125+8), or 0.6, which is 3.0 inches instead of 5.0. Hence the total loss in height of the cell under this load is 2+2.5+.5, or 5.0 inches.

This is at about the limit of acceptability, and is the maximum load under any circumstances. The load of a knee supporting the trunk will be no greater, and the load per unit area of a seated figure will be less. Hence the design is capable of taking care of all possible cases. Alternatively, the cell could be made to contain only 4.0 inches of 3-inch diameter sections instead of 5.0 inches, in which case the extreme compression would be shortened by about one-half inch. Other properties would be affected, but design choices are available especially in the diameter or diameters of the small cylindrical section at the top.

The plenum 21 comprises a shallow enclosed volume extending across the bottom of the mattress and providing an air passage to each cylinder. It can be shaped into a network of small passages or it can be a fairly open passageway which is quilted to or tacked against the bottom. Its volume or depth can be minimal, averaging, for example, less than one-half inch. One reason for keeping the depth small is to minimize the loss of height in the plenum under a loaded cylinder. Because air in the plenum can flow to other portions of the plenum, the plenum will collapse locally under moderate loads. If it is only one-half inch deep, for example, this effect will be tolerable.

The dimensions of the small cylinder 16 of each cylinder 10 are chosen so that it will collapse sufficiently to enable the associated valve 18 to seal the registering orifice 17 if a very moderate load is applied to the cylinder, such as, for example, 10% of the trunk load, to represent an arm, e.g., 0.0016 $kg/cm^2$. Since the cylinder is not sealed to begin with, the rise in pressure during this phase of operation must come about because of restriction of outward flow in the space between the orifice 17 and the valve 18. Hence this requirement determines the orifice size.

Assuming that an orifice so specified is used, we can calculate the area of the cylinder such that a specified length of compression occurs for a specified pressure difference. If a change in height of 0.25 inches is assumed, a cylinder section 1.25 inches will compress that much under a pressure of 0.0016 $kg/cm^2$. Obviously a much smaller diamter could be used if necessary, so that this gives considerable design latitude for choosing the threshold pressure for obtaining closure.

The face that the valve 18 seals only after the body load reaches a pre-assigned value has significant consequences in the feel of the mattress. If the lying occupant rolls to a new position, the air in the neighboring unused and still-open cylinder 10 will flow out briefly at low pressure. This means that the mattress responds softly and unresistively as the body occupies new positions. It will continue to respond softly even after sealing, so long as this lower section 16 of smallest diameter is collapsing. Then, as the section 15 of intermediate diameter begins to compress; it will begin to respond at a somewhat higher spring constant, in accordance with the illustrative example given.

When the occupant rises from the bed, all the valves of cylinders 10 open and the original equilibrium pressure is reestablished. During a single session of use, cylinders 10 will lose and regain small amounts of air, but only in a set of completed cycles. During one session of use, a loss is always followed, if at all, by a gain, and vice versa. No air flows occur which are cumulative.

Figure 3:
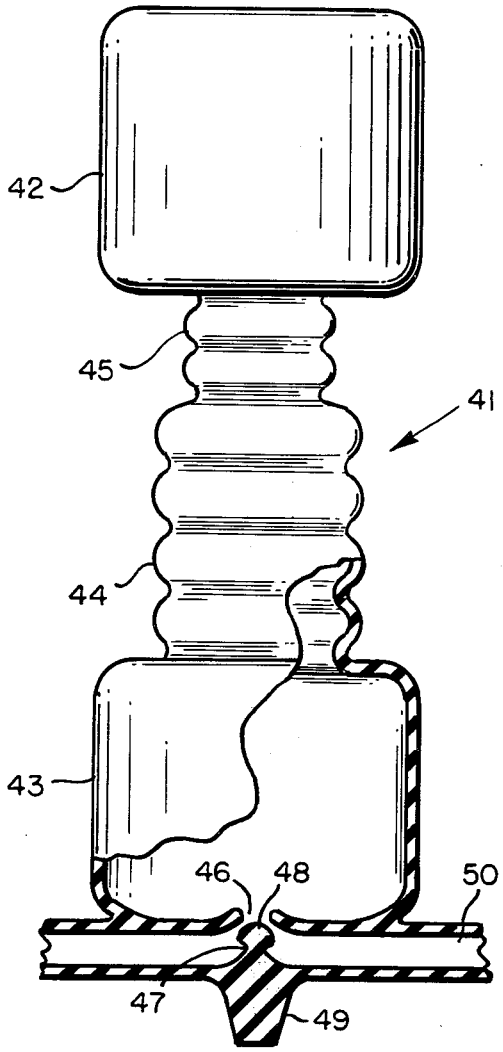
FIG. 3 is a view similar to FIG. 1 but illustrating a modified form of air cell and valve therefor which may be used in a mattress of the type disclosed herein.

As an alternative cell design, it is possible to replace the automatic cell valves with manual valves. As shown in FIG. 3, the modified cell 41 has maximum diameter regions 42 and 43 connected by regions 44 and 45. A valve 47 is designed to seal cell 41 when the valve head 48 is pressed through an orifice 46, which constitutes the cell's air passage to a plenum 50. A mattress made from such cells is filled with air in the usual manner, through the plenum 50, and then the plenum is closed to the outside. With the mattress thus sealed, each manual valve 47 is closed by pressing its head 48 into and through the associated orifice 46. Each cell remains sealed during usage; it is unsealed only if, for example, it is desired to deflate the mattress. In this eventuality, the valve 47 on each cell is pulled out with its associated tab 49, which projects from the outer surface of plenum 50.

The only change in performance which this would cause, compared to the cell 10 of FIG. 1, is that the initial response of a cell of FIG. 3 to a load would not be that of the extreme softness of the open state of the cell of FIG. 1, which can leak some air before it closes. However, this can be compensated for by introducing a cylindrical section of very small diameter, since according to the principle of gas physics as already cited, this will respond with great compressibility and softness. Region 45 of FIG. 3, with, for example, a relatively small diameter of 1 inch in the embodiment illustrated, constitutes such a section.

It should also be noted that region 45 is also short, only one inch long in the embodiment shown, so that its soft response cannot lead to more than an initial pleasant small sinking; then the normal medium stiff response is taken over by region 44, whose proportions are like those of region 15 of cell 10.

The locations of these regions along the height of the cell 41 is not material; each one can be higher or lower, and they can be separated. Also, the regions 44 and 45 can be graded in diameter to form a smooth transition from one to the other. The latter choice would lead to a different load-response characteristic. Such characteristics are highly subjective and can be tailored to the preferences of the consumer.

It should be recognized that by placing the cell valves within the air volume of the mattress, a major advantage is obtained over previous inventions, e.g., U.S. Pat. No. 2,415,150, in which cells were individually filled and individually closed while exposed to the outside atmospheric pressure. In our case, where the cells are being closed within the mattress, there is no pressure difference across the valve, and no skill is needed to prevent leakage of air.

Furthermore, subsequent leakage is not a major problem, since the pressure difference between the cell and the plenum is small even when loaded, and no pressure difference exists across the valve when the mattress is not in use. The valve can be designed to experience additional sealing pressure when the cell is loaded.

Figure 4:
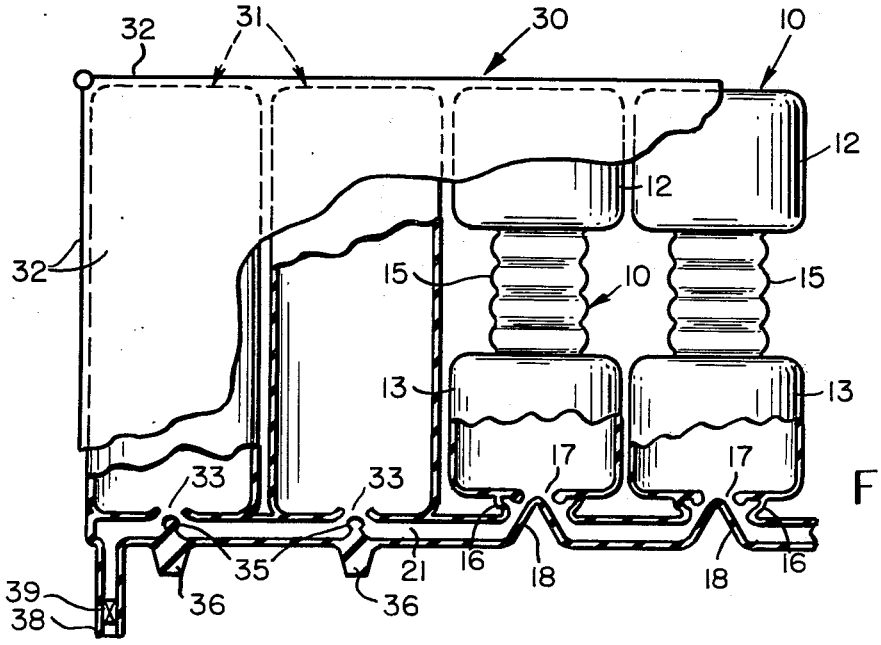
FIG. 4 is an enlarged, fragmentary, side elevational view of a corner of a mattress made according to another embodiment of this invention, portions of this mattress being broken away and shown in section.
Figure 5:
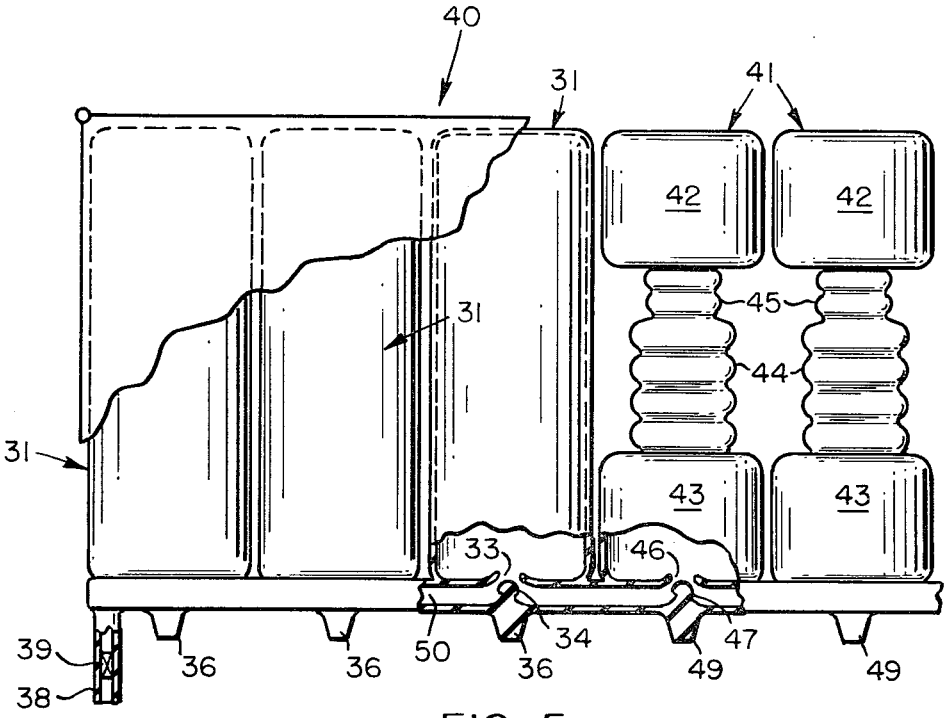
FIG. 5 is a fragmentary view similar to FIG. 4, but showing still another form of air mattress.

FIGS. 4 and 5 illustrate mattresses made in accordance with the principles above. FIG. 4 illustrates a mattress 30 utilizing, at least in part, the principles of automatically sealing valves; and FIG. 5 illustrates a mattress 40 utilizing the principles of manually sealed valves.

FIG. 4 is a cross section of a mattress 30 showing typical cells starting from the left boundary of the mattress. It has at its boundary two rows of truly cylindrical cells 31 which do not have intermediately located small diameter sections 15, so that the periphery of the mattress will be stiff, to provide for sitting. The cells are optionally of the manual sealing type, although they could alternatively have been of the automatic sealing type if terminated at their lower extremities with the structures 16, 17 and 18 of cells 10, as described below. The two rows of cylinders 31 extend completely around the mattress. The boundary cells are in turn enclosed in a conventional cover 32, which is strong enough to bind the cells 10 and 31 in upright positions.

The interior cells 10 are equipped with automatic valves 18. These are formed as part of the inside of the plenum 21, and are registered with the orifices 17, as in the case of mattress 20 of FIG. 2.

To fill the mattress, air, or the like, is adapted to be supplied to plenum 21 in mattress 30 by a tube 38, which is secured at one end in communication with the interior of plenum 21, and which has intermediate its ends a conventional valve 39, which operates in known manner to control the flow of gas into or out of plenum 21. In the preparation of the mattress for use, the orifices 17 and 33 are open, so that any air under pressure supplied through tube 38 to plenum 21 will be distributed to all of the cylinders 10 and 31 in the mattress. When the mattress 30 has been filled with the desired amount of air, the tabs 36 are used to force the associated valves 35 into the registering orifices 33, thereby to seal the latter. Once one of the orifices 33 is closed, it would remain that way unless one wished, for example, to deflate the mattress, in which case valves 35 are pulled out manually by their tabs 36. Otherwise, the cells 31 would operate in a permanently sealed state.

In the filling process, the cells 10 constituting the remainder of the mattress 30 fill through orifices 17. These cells 10 do not seal until a load is applied, in which case valves 18 seal against orifices 17, as previously described.

FIG. 5 shows an alternative construction for a mattress. The essential difference from the mattress 30 of FIG. 4 is that all the cells of mattress 40 are to be sealed manually. The peripheral cells 31, of uniform diameter and hence very stiff, are like those of FIG. 4, including valves 34 and orifices 33. They provide a firm edge for sitting. The interior cells 41, however, are of the type shown in FIG. 3 and are designed to operate as permanently closed cells.

To fill the mattress 40, the procedure is the same as that of FIG. 4, except that, now, in addition, it is also necessary to close cells 41 by forcing valves 47 into orifices 46. That is, all cells of the mattress must be manually sealed to prepare the mattress for use. As previously noted, a major advantage of the design is that the operation of sealing individual cells is simple, since it does not involve coping with a difference in air pressure or problems of escaping air.

Figure 6:
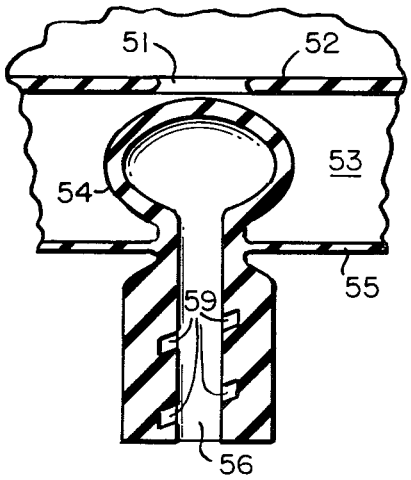
FIGS. 6 and 7 are enlarged, fragmentary sectional views illustrating in its open and closed positions, respectively, still another form of valve which can be employed for sealing air cells of the type disclosed herein.
Figure 7:
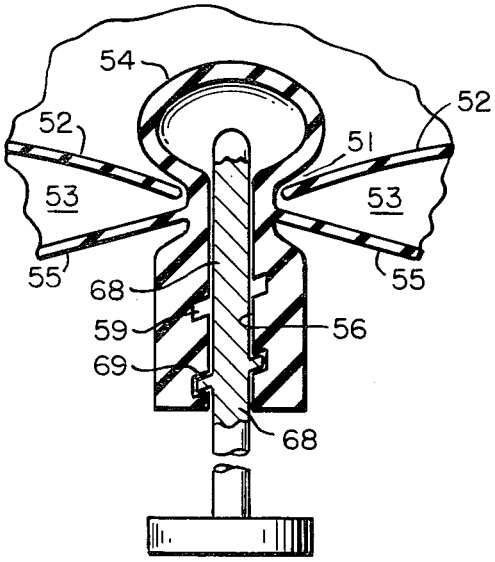

FIGS. 6 and 7 illustrate a modified form of the type of valve which is manually closed. In FIG. 6 the hollow valve 54 is shown in its unseated position. The orifice of an associated cell is shown at 51, surrounded by the lower wall 52 of the cell. The plenum for the associated mattress is the volume 53. The valve 54 is attached intermediate its ends to the lower wall 55 of the plenum 53. A bore 56 in the valve is open to the outside and is internally threaded as at 59.

FIG. 7 shows how the valve 54 locks after it has been forced through the orifice 51 by a plunger 68, which is externally threaded as at 69. The valve bore 56 has internal threads 59, so the plunger can be threaded into the bore 56 and forced upwardly to distort the valve into a long and narrow shape. Then the plunger 68 and the valve body as a whole are pushed upward along with the adjoining portion of the lower plenum wall 55 so that the valve 54 passes through the orifice 51. The plunger 68 is then removed or partially removed from the bore 56 as shown in FIG. 7, and the valve resumes its original shape inside the orifice, thus sealing the cell as shown in FIG. 7.

To extract the valve 54 from the orifice, the plunger 68 is once more screwed into the valve to elongate it. Then the plunger is pulled outward carrying the valve head 54 out of the orifice 51. The removable plunger 68 is used in the same way on all the valves 54.

Figure 8:
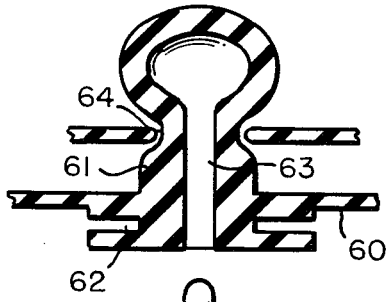
FIG. 8 is an enlarged, fragmentary sectional view showing in its closed position, a modification of the valve shown in FIGS. 6 and 7.
Figure 9:
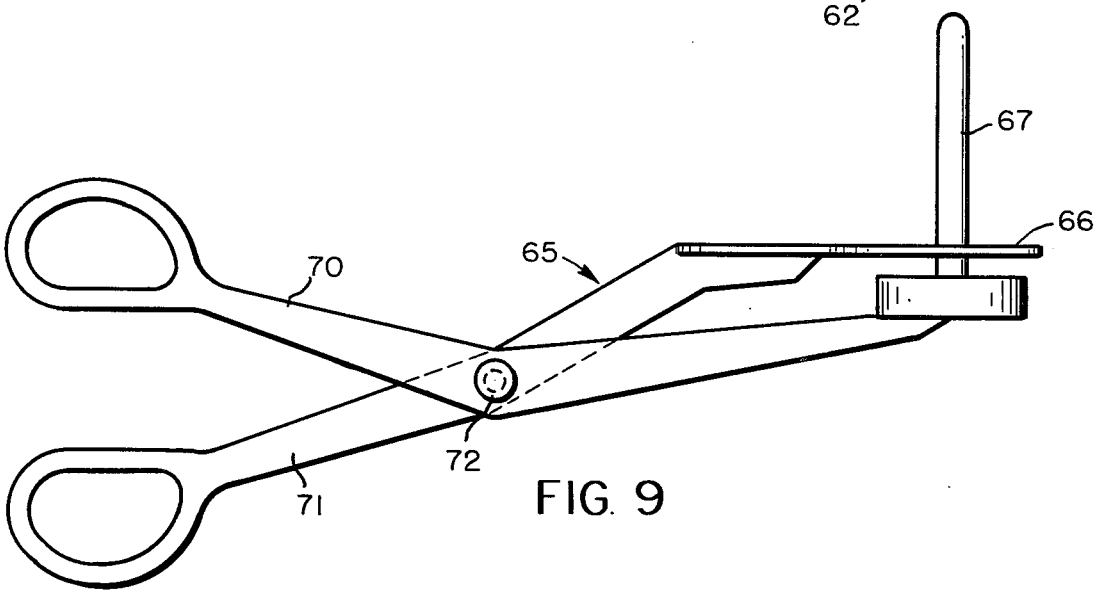
FIGS. 9 and 9A are elevational and plan views, respectively, of one type of tool which can be used for operating the valve shown in FIG. 8.
Figure 9A:
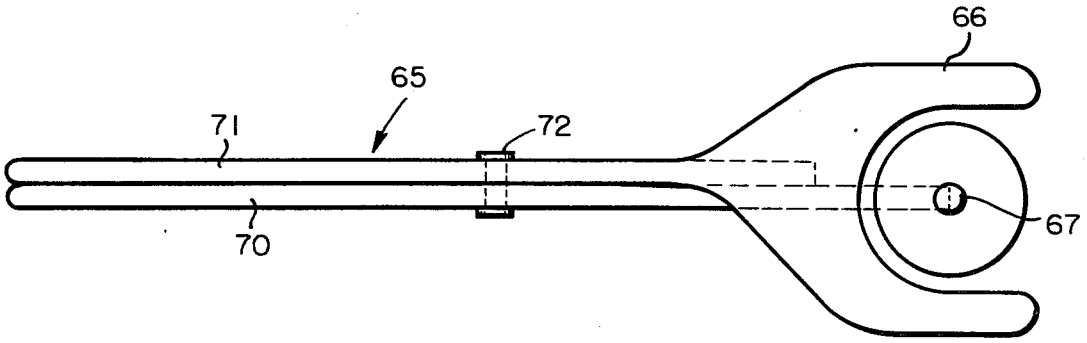

FIG. 8 illustrates a modified hollow valve body 61, which is integral intermediate its ends with the lower plenum wall 60 of a mattress, and which has in its outer end an external slot 62 which is in the form of a ring. Valve 61 is operable by a scissor-type tool 65 having two members 70, 71 pivotally connected approximately medially of their ends by a pin 72. The slot 62 is adapted to be gripped by a thin fork or yoke 66 formed on one end of member 71, while a cylindrical plunger 67 on the adjacent end of member 72 is adapted to be forced into the bore of valve 61 to stretch the latter by manipulating members 70, 71 in a manner that will be apparent from the drawings.

As in FIGS. 6 and 7, the head of valve 61 is then thrust through the cell orifice 64 to place the valve in sealing position within the cell, and the rod 67 is then withdrawn, leaving the cell sealed by the re-expanded valve. Withdrawal of valve 61, if desired for any reason, is accomplished by reversing the process.

From the foregoing it will be apparent that the instant invention provides mattress structures which offer localized response to the local weight in the area of the body resting thereupon. This is accomplished by isolating a volume of air for each body area, by a design which permits such isolation while also permitting the filling of the entire mattress at one place only. Still another advantage is that each cell performs in such a manner that the response of the column of air therein is soft, as a load is applied to the cell, by virtue of the fact that each cell comprises sections of smaller diameter which enable temporary reduction in the height of the column of air normally contained in each cell. Moreover, by allowing small amounts of air to escape locally during the initial application of the load, the automatically valved cells of the type denoted at 10 provide an extremely soft, initial response to the application of the load. By using essentially inelastic material for forming the various cells, it is possible to design each cell to provide the desired response to the application of the load, particularly when the cell incorporate valves of the type disclosed in this application. In addition, since the valves for the cells are located within the plenum area, there is no pressure differential between the plenum and unloaded cells, so that the operation of the manually operable type valves is substantially easier as compared to constructions in which the valves are disposed exteriorly of a plenum.

While this invention has been illustrated and described in detail in connection with only certain embodiments thereof, it will be apparent that it is capable of still further modification, and that this application is intended to cover any such modifications that may fall within the scope of one skilled in the art or the appended claims.

Having thus described my invention, what I claim is:

1. A pneumatic mattress, comprising a first plurality of flexible, hollow cells, which are similar in configuration and circular in cross section, each of said cells comprising at least one section of relatively large diameter, and at least another section smaller in diameter than said one section and connected coaxially to said one section, means for supporting said cells in side-by-side vertical relation with the upper ends of the uppermost of said sections disposed in coplanar relation, said means including a flexible plenum extending completely and continuously beneath the lower ends of said cells, and each of said cells having in the lower end thereof an orifice for connecting the interior of each cell with the interior of said plenum, means for supplying gas under pressure to the interior of said plenum for distribution through said orifices to said cells, and a plurality of valves in said plenum releasably insertable into said orifices for individually closing the orifices in said cells individually to trap gas under pressure in said cells, when closed, thereby to prevent return thereof to said plenum.

2. A pneumatic mattress as defined in claim 1, wherein said supporting means further comprises means resiliently supporting the lower end of each of said cells with the orifice therein disposed in spaced, registering relation to one of said valves, whereby upon application of force to the upper end of a cell, the cell descends and urges the orifice in the bottom thereof automatically into sealing engagement with the registering valve.

3. A pneumatic mattress as defined in claim 2, wherein said means resiliently supporting the lower end of each cell comprises a cylindrical portion on each cell interposed between the bottom of the cell and said plenum, and surrounding the orifice in said cell and having a diameter smaller than any of the other sections of said cell, whereby when said force is applied to the top of the cell, the cell collapses slightly in the area of said cylindrical portion allowing some gas to escape from the cell to said plenum before the orifice is closed by its associated valve.

4. A pneumatic mattress as defined in claim 3, wherein the overall length of the sections having said large diameter exceeds 5.0 inches, said large diameter is in the range of approximately 3.0 to 5.0 inches, and the diameter of said other section falls in the range of approximately 1.0 to 2.0 inches.

5. A pneumatic mattress as defined in claim 2, wherein each of said valves is generally conical in configuration and its pointed end enters one of said orifices to seal it, and is withdrawn automatically therefrom upon removal of said force.

6. A pneumatic mattress as defined in claim 1, wherein each of said valves projects from the interior of said plenum into registry with an orifice in the bottom of one of said cells, and has a resilient, enlarged-diameter head which is adapted to be press fit manually through the orifice in the registering cell individually to open or close said orifice, and a plurality of tabs project exteriorly of said plenum opposite said valves to allow manual operation thereof.

7. A pneumatic mattress as defined in claim 1, including a second plurality of flexible, hollow cells of similar configuration surrounding said first plurality of cells, and at least a portion of each of said second plurality of cells being uniformly cylindrical intermediate its ends.

8. A pneumatic mattress as defined in claim 1, wherein said one section of each cell is cylindrical and said other section is corrugated.

9. A pneumatic mattress as defined in claim 8, wherein each cell comprises a pair of said cylindrical sections interconnected by one of said corrugated sections.

10. A pneumatic mattress as defined in claim 9, wherein there are at least two corrugated cylindrical sections interconnecting said pair of cylindrical sections coaxially thereof, and one of said two corrugated sections is smaller in diameter than the other corrugated section.

11. A pneumatic mattress as defined in claim 1, wherein each of said valves is a flexible tubular member secured intermediate its ends in one wall of said flexible plenum and having a closed inner end registering with one of said orifices and being larger in diameter that the diameter of the last-named orifice, whereby to close said valve a member may be inserted into the bore in said tubular member from the exterior of said plenum to force the enlarged inner end of said member through said last-named orifice to seal the latter.

12. A pneumatic mattress as defined in claim 11, wherein said tubular member is internally threaded and is engageable by the externally threaded shank of a hand tool for operation by the latter between open and closed positions, respectively, relative to said last-named orifice.

13. A pneumatic mattress as defined in claim 11, wherein said tubular member has an external ring-shaped slot engageable by a yoke-shaped hand tool for holding and operable with a plunger inserted into the bore in said tubular member from the exterior of said plenum to force the enlarged inner end of said member through said last-named orifice to seal the latter.

14. In a pneumatic mattress, a first plurality of flexible, hollow cells, which are similar in configuration, means supporting said cells in side-by-side vertical relation with the upper ends thereof disposed generally in coplanar relation, said means including a flexible plenum extending completely and continuously across said cells at one end thereof, and each of said cells having in said one end thereof an orifice for connecting the interior of each cell with the interior of said plenum, means for supplying gas under pressure to the interior of said plenum for distribution through said orifices to said cells, and a plurality of valves in said plenum for individually closing the orifices in said cells individually to trap gas under pressure in said cells and to prevent return thereof to said plenum, when closed, each of said cells having arranged one above the other at least two interconnected sections the average cross sectional areas of which are different, and at least one of said two sections of each cell being corrugated and the other of said two sections being non-corrugated.

15. A pneumatic mattress as defined in claim 14, wherein said non-corrugated section is cylindrical and has a length that exceeds 5.0 inches, the diameter of said cylindrical section falls in the range of approximately 3.0 to 5.0 inches and the diameter of said corrugated section falls in the range of approximately 1.0 to 2.0 inches.

16. A pneumatic mattress as defined in claim 14, wherein each of said cells has a further, non-corrugated section thereof interconnected by said corrugated section to the first-named non-corrugated section of the cell, and said non-corrugated sections are similar and have cross sectional areas larger than the average cross sectional area of said corrugated section.

17. A pneumatic mattress as defined in claim 16, wherein each of said cells includes a second corrugated section interconnected to said two non-corrugated sections and the first-named corrugated section, and having an average cross sectional area smaller than that of said first-named corrugated section.

* * * * *